US005590575A

United States Patent [19]

Ludy

[11] Patent Number: 5,590,575

[45] Date of Patent: Jan. 7, 1997

[54] LEVER TOOL HANDLE

[76] Inventor: Andrew W. Ludy, 17 Sherwood Way, Landing, N.J. 07850

[21] Appl. No.: 432,370

[22] Filed: Apr. 28, 1995

[51] Int. Cl.[6] ..... B25B 23/16

[52] U.S. Cl. ..... 81/177.5; 81/177.7

[58] Field of Search ..... 81/177.5, 177.2, 81/177.7, 177.8, 489, 177.1, 177.6, 58.1; 16/114 R, 112, 115, 126, 127; 403/326, 330

[56] References Cited

U.S. PATENT DOCUMENTS

| | | | |
|---|---|---|---|
| 1,476,007 | 12/1923 | Rude | 81/177.2 |
| 3,159,867 | 12/1964 | Aciego | 16/126 |
| 3,173,462 | 3/1965 | Koeppel | 81/177.1 |
| 3,863,693 | 2/1975 | Carriker | 81/177.6 |
| 4,000,767 | 1/1977 | Geng | 81/177.2 |
| 4,589,163 | 5/1986 | Weatherby et al. | 16/127 |

FOREIGN PATENT DOCUMENTS

| | | | |
|---|---|---|---|
| 579494 | 10/1924 | France | 81/177.7 |
| 464760 | 7/1951 | Italy | 81/177.7 |
| 180443 | 6/1922 | United Kingdom | 81/177.7 |

*Primary Examiner*—James G. Smith
*Assistant Examiner*—Joni B. Danganan
*Attorney, Agent, or Firm*—Andrew W. Ludy

[57] ABSTRACT

A lever handle, for a rotary hand tool such as a screwdriver, increases the operating torque of the tool to free a stuck fastener, and includes a generally U-shaped lever member pivotally mounted near the end of the handle, the lever member pivoting from a closed position alongside the handle wherein the tool will be rotated freely and quickly, and wherein a detent releasably holds the lever member in the closed position, to an open position projecting outward from the handle wherein the tool will be operated with increased torque to turn a rotary fastener, with either hand or with both hands, the handle including tapered slots to resiliently expand the lever member for assembly onto the handle.

10 Claims, 3 Drawing Sheets

LEVER TOOL HANDLE

BACKGROUND OF THE INVENTION

The present invention relates generally to handles for manually operated tools and pertains, more specifically, to a lever handle to increase the operating torque of a rotary hand tool such as a screwdriver, nutdriver, hex socket head driver, torx head driver, and the like, to free and remove stuck or rusted screws and other rotary fasteners or to assemble new fasteners with extra torque.

Lever handles for screwdrivers are known and, heretofore, have been configured in different ways. Some examples of lever handles in the prior art are seen in the following U.S. patents:

Schwalbe, U.S. Pat. No. 4,825,734, shows a handle in two parts pivotally joined in a tongue and clevis joint, with a spring and pin detent. Pivoting the lever member into the operating position shortens the handle by half, making it too short to grasp securely, unless it is made overly long to begin with. Furthermore, the detent will not prevent inadvertent pivoting of the lever member when it is not desired. Lastly, the construction has many parts and requires laborious assembly.

Miyamoto, U.S. Pat. No. 4,799,407, illustrates a lever member with one end bent at right angles for insertion into a hole near the bottom of a grip member. The lever member does not fold up against the grip member for storage, but must be installed before use and detached after. Another problem is that the tool cannot be operated with one hand due to the lever member mounting at the bottom of the grip member.

Wilson, U.S. Pat. No. Des. 175,056, shows two U-shaped lever members pivotally attached with pins to opposite sides of a grip member midway along it's length, This attachment limits the length of the lever member and the torque it can develop, and interferes with comfortable grasping of the handle. In addition, one of the lever members is superfluous, and the assembly is complicated.

Jang, U.S. Pat. No. 4,542,667, utilizes two lever members pivotally mounted at the top end of the grip member, and a spring and plate detent assembly, One of the two lever members is superfluous, and the number of parts is excessive.

Janes, U.S. Pat. No. 3,342,227, Carriker, U.S. Pat. No. 3,863,693, Geng, U.S. Pat. No. 4,000,767, Royer, U.S. Pat. No. 4,196,761, Kraus, U.S. Pat. No. 4,235,269, and McGee, U.S. Pat. No. 3,797,546, all employ a lever member pivotally attached with a pin to the bottom end of a grip member. This attachment precludes one hand operation of the tool. These inventions, and those of Wilson and Jang, show a complicated assembly requiring either press fitting of pins into drilled and reamed holes, or insertion and cold-heading of a rivet to pivotally attach the lever member to the grip member.

SUMMARY OF THE INVENTION

It is therefore an object of the present invention to provide a lever tool handle that has a minimum number of parts, having only a grip member and a lever member.

Another object of the invention is to provide a lever tool handle of the type described and in which the lever member is assembled onto the grip member quickly and easily and without tools by snapping the parts together.

Still another object of the invention is to provide a lever tool handle of the type described and which can be operated either with one hand or with both hands.

Yet another object of the invention is to provide a lever tool handle of the type described and which has a detent to hold the lever member in the closed position yet release it easily when needed.

A further object of the invention is to provide a lever tool handle of the type described and in which the detent is molded in one piece with the grip member, requiring neither parts nor assembly.

Yet a further object of the invention is to provide a lever tool handle of the type described and in which the grip member is electrically insulated for safety.

A still further object of the invention is to provide a lever tool handle of the type described and which is easily adapted for use with tools having various operating tips, such as blade, philips, hex, or torx screwdrivers.

An additional object of the invention is to provide a lever tool handle of the type described and which can be manufactured cost effectively in large numbers of high quality.

A yet additional object of the invention is to provide a lever tool handle of the type described and which is rugged in construction to ensure reliable operation and long life.

The above objects, as well as further objects and advantages, are attained by the present invention which may be described briefly as a lever handle for a rotary hand tool having a shank With a tip configured to engage and turn a rotary fastener, the lever handle enabling operation with one hand to apply increased torque to the rotary fastener, the lever handle comprising: a grip member having a longitudinal axis, a generally cylindrical surface extending along the longitudinal axis and having a diameter suitable for hand grasping, opposite first and second ends, the shank extending collinearly from the first end, the grip member having two collinear pivot holes transverse to the axis of the grip member, the pivot holes juxtaposed with the second end; a lever member, the lever member having a generally one piece structure, U-shaped and resilient, and including a pair of side elements, the side elements being generally parallel and including opposite first and second ends; a connecting element disposed between the first ends of the side elements and connected thereto; a pair of collinear pivot elements, each pivot element having opposite fixed and free ends, the fixed ends connected to and extending generally perpendicularly to the second ends of the side elements, the free ends pointing inward and pivotally engaging the pivot holes of the grip member so that the lever member will be pivoted in an arcing path from a closed position alongside the grip member and substantially parallel to the longitudinal axis of the grip member wherein the rotary hand tool will be rotated freely and quickly, to an open position projecting outward from the grip member adjacent the second end of the grip member for enabling the rotary hand tool to be operated with one hand with increased torque to turn a rotary fastener; and a detent disposed on the side of the grip member, the detent including a projecting portion being one piece with the grip member, the projecting portion projecting outward into the path of the lever member as the lever member is moved between the open position and the closed position, such that the side elements of the U-shaped lever member, biased through the connecting element, expand resiliently apart from one another in response to passing over the projecting portion, and contract so as to be releasably held behind the projecting portion in the closed position.

BRIEF DESCRIPTION OF THE DRAWING

The invention will be more fully understood, while still further objects and advantages will become apparent, in the following detailed description of preferred embodiments thereof illustrated in the accompanying drawing, in which.

DESCRIPTION OF THE PREFERRED EMBODIMENTS

Figure 1:
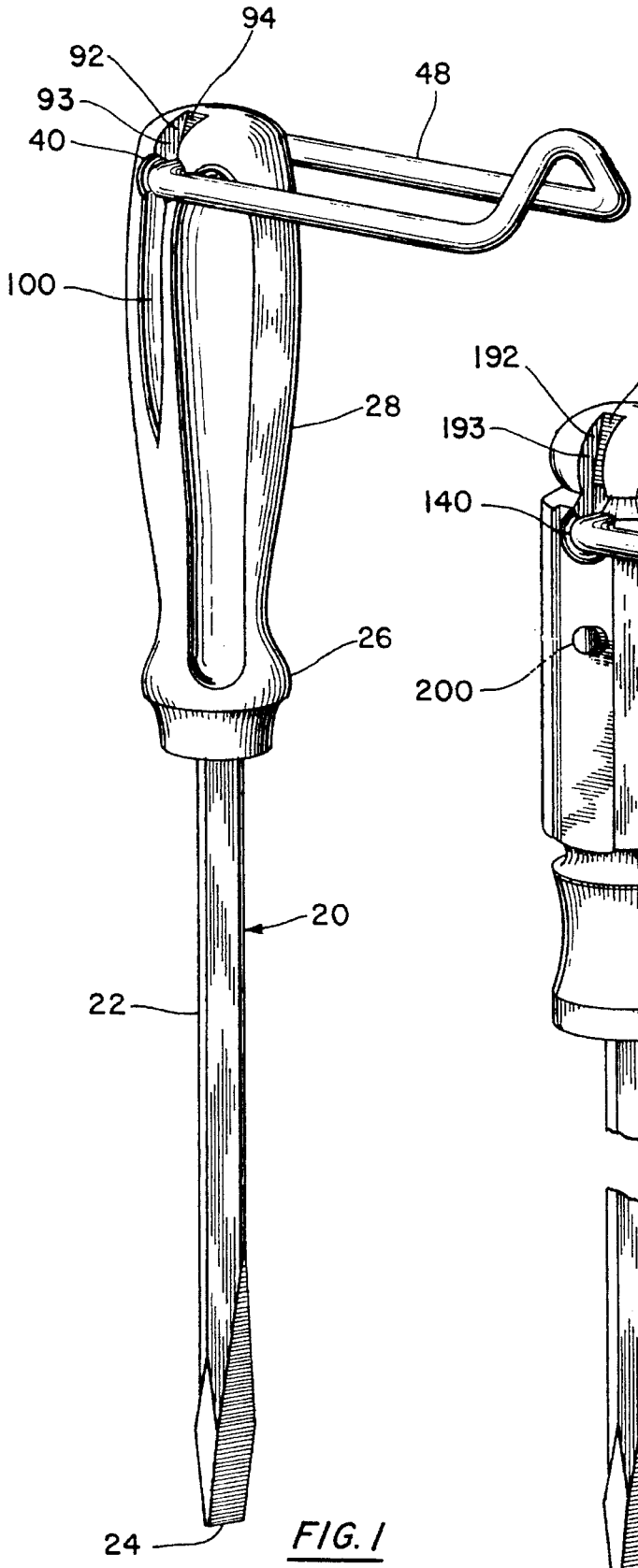
FIG. 1 is a perspective view of a rotary hand tool having a lever handle constructed in accordance with the invention.

Referring now to the drawing, and especially to FIGS. 1,3,4,5,6, and 7, a rotary hand tool is shown at 20, and includes a shank 22, a tip 24, and a lever handle constructed in accordance with the invention at 26. The tip 24 shown in FIG. 1 is a blade type tip for use with a slotted screw, but various tips may be used, such as hex, phillips, torx, or any tip adapted for use with a rotary hand tool.

The lever handle 26 has a grip member 28 with a first end 32, an opposite second end 34, and a cylindrical surface 30 extending along it's longitudinal axis. The cylindrical surface 30 of the grip member 28 includes a plurality of longitudinal ridges, shown at 80, 82, 84, and 86, the plurality of ridges including a pair of generally opposite ridges, 82 and 86. The grip member 28 has two collinear pivot holes 36 and 42, located on corresponding surfaces of the pair of opposite ridges 82 and 86. The pivot holes 36 and 42, are generally perpendicular to the axis of the grip member 28 near the second end 34. The outer edges 40 and 46 of the pivot holes 36 and 42 respectively, are radiused.

The lever handle 26 includes a lever member 48 which is made of round cross section rod, having a one piece structure, being U-shaped and resilient, and has a pair of side elements 50 and 56, the side elements 50 and 56 being generally parallel and including first ends 52 and 58, and opposite second ends 54 and 60, respectively.

A connecting element 62 is disposed between the first ends 52 and 58 of the side elements 50 and 56, and connected thereto with radiused connections 112 and 114 respectively, the connecting element 62 being arcuate to conform to the cylindrical surface 30 of the grip member 28.

The lever member 48 includes a pair of collinear pivot elements 64 and 70, each pivot element having fixed ends 66 and 72, and opposite free ends 68 and 74 respectively. The fixed ends 66 and 72 extend generally perpendicularly to the second ends 54 and 60 of the side elements 50 and 56, and are connected thereto with radiused connections 116 and 118 respectively. The free ends 68 and 74 of the pivot elements 64 and 70 point inward and pivotally engage the pivot holes 36 and 42 respectively, of the grip member 28 so that the lever member 48 will be pivoted in an arcing path from a closed position shown by arrow 76, alongside the grip member 28 and substantially parallel to the longitudinal axis of the grip member 28 wherein the rotary hand tool 20, with no impediment to comfortable hand grasping and operating, will be rotated freely and quickly, to an open position shown by arrow 78, projecting outward from the grip member 28 wherein the rotary hand tool 20 will be operated with increased torque to turn a rotary fastener. In the open position 78, the rotary hand tool 20 may be operated with one hand, either right or left, or with both hands together.

A first plane containing the connecting element 62, is generally perpendicular to a second plane containing the side elements 50 and 56, and the pivot elements 64 and 70.

The invention features a unique structure for assembling the lever member 48 onto the grip member 28, wherein the grip member 28 includes two slots 92 and 96 disposed on opposite sides of the grip member 28 and aligned generally with the longitudinal axis, the slots 92 and 96 communicating with the pivot holes 36 and 42 respectively, the slot 92 including innermost surfaces 94 and a pair of sidewalls 93, and the slot 96 including innermost surface 98 and a pair of sidewalls 97, the distance between the innermost surfaces 94 and 98 of the slots 92 and 96 tapering inward from adjacent the pivot holes 36 and 42 toward the second end 34 of the grip member 28. The pivot holes 36 and 42 include bottom surfaces 38 and 44 respectively, spaced apart less than the distance between the innermost surfaces 94 and 98 of the slots 92 and 96 adjacent the pivot holes 36 and 42, so that upon assembling the lever member 48 onto the grip member 28, the pivot elements 64 and 70 will engage the slots 92 and 96 at the second end 34 of the grip member 28 without bias, the sliding movement of the pivot elements along the slot taper will resiliently expand the lever member 48, the slot sidewalls 93 and 97 will guide the pivot elements 64 and 70 toward the pivot holes 36 and 42, and the pivot elements 64 and 70 will enter the pivot holes 36 and 42 respectively, enabling the lever member 48 to contract in response to the resilient bias of the lever member 48. The invention may thereby be assembled quickly and easily, with no tools, by simply snapping the parts together by hand. The lever handle 26 has a detent including projecting portions 88 and 90 being one piece with the grip member on the pair of opposite ridges 82 and 86 respectively, the projecting portions 88 and 90 projecting outward into the path of the lever member 48 to resiliently expand the lever member 48 in response to passing over the projecting portions 88 and 90 as the lever member 48 is moved between the open position 78 and the closed position 76, a pair of generally longitudinal grooves 100 and 102 located along projecting portions 88 and 90 respectively, such that the lever member 48 contracts resiliently behind the projecting portions 88 and 90 and into the grooves 100 and 102 when the lever member 48 is in the closed position 76 so as to be releasably held in the closed position 76.

Figure 8:
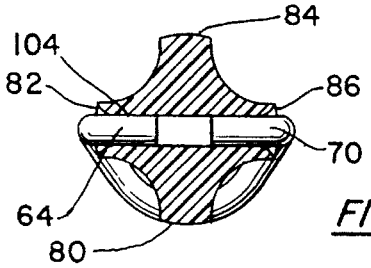
FIG. 8 is a top cross-sectional view of yet another lever handle constructed in accordance with the invention, taken along line 7—7 of FIG. 4.
Figure 7:
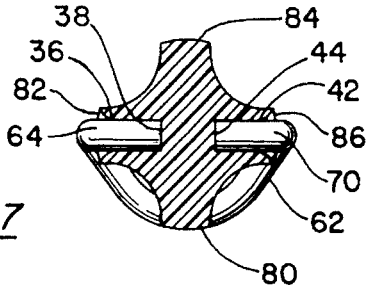
FIG. 7 is a top cross-sectional view of the lever handle of FIG. 1, taken along line 7—7 of FIG. 4.
Figure 5:
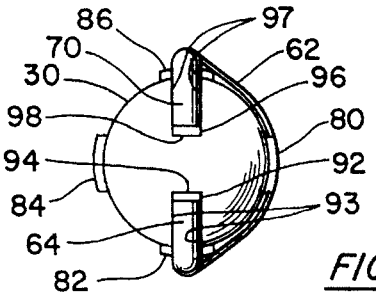
FIG. 5 is a top plan view of the lever handle of FIG. 1.
Figure 6:
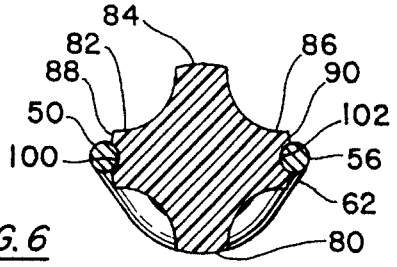
FIG. 6 is a top cross-sectional view of the lever handle of FIG. 1, taken along line 6—6 of FIG. 4.
Figure 3:
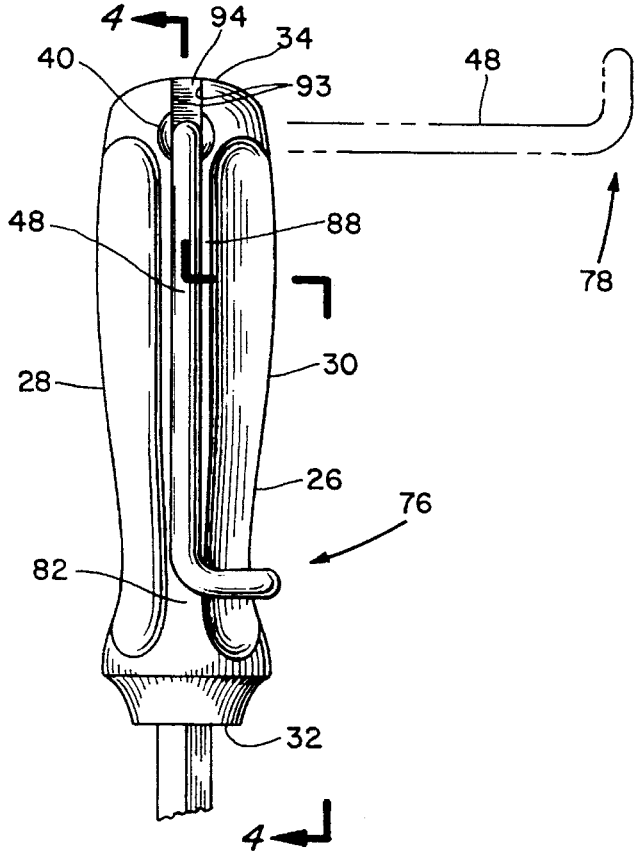
FIG. 3 is a left side view of the lever handle of FIG. 1.
Figure 4:
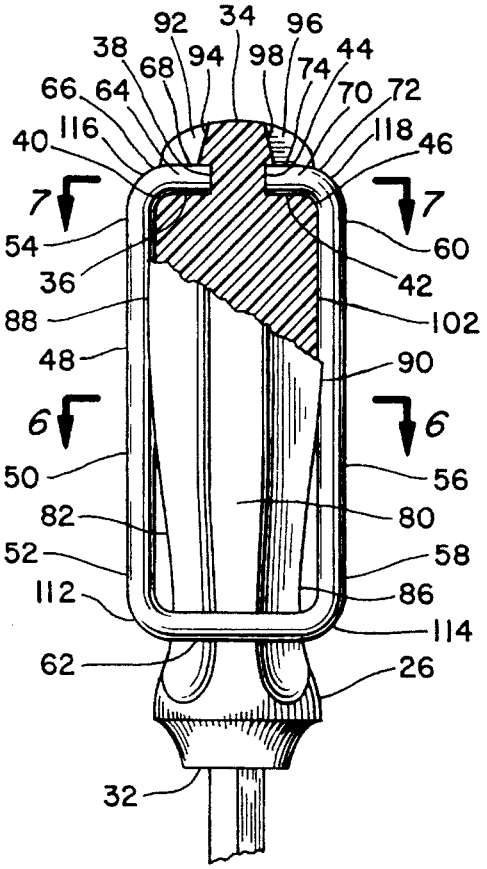
FIG. 4 is a front elevational cross-sectional view of the lever handle, of FIG. 1, taken along line 4—4 of FIG. 3.

Referring now to FIG. 8, as well as to FIGS. 1,3,4,5, and 6, another lever handle constructed in accordance with the invention is shown in FIG. 8, and is similar to the invention of FIG. 1 except that the pivot holes 36 and 42 communicate with one another, forming one continuous hole 104 through the grip member 28.

Turning now to FIGS. 2,9,10,11,12, and 13, a rotary hand tool is shown at 120, and includes a shank 122, a tip 124, and yet another lever handle constructed in accordance with the invention at 126.

The lever handle 126 has a grip member 128 with a first end 132, an opposite second end 134, and a cylindrical surface 130 extending along it's longitudinal axis. The cylindrical surface 130 of the grip member 128 includes a plurality of longitudinal ridges shown at 180, 182, 184, 186, 188, and 190. The grip member 128 has two collinear pivot holes 136 and 142 generally perpendicular to the axis of the grip member 128 near the second end 134. Each of the pivot holes 136 and 142 is located between adjacent ridges. Pivot hole 136 is located between adjacent ridges 182 and. 184, and pivot hole 142 is located between adjacent ridges 188 and 190. The outer edges 140 and 146 of pivot holes 136 and 142 respectively, are radiused.

The lever handle 126 includes a lever member 148 which is made of round cross section rod, having a one piece structure, being generally U-shaped and resilient, and has a pair of side elements 150 and 156, the side elements 150 and 156 being generally parallel and including first ends 152 and 158, and opposite second ends 154 and 160, respectively.

A connecting element 162 is disposed between the first ends 152 and 158 of the side elements 150 and 156, and connected thereto with radiused connections 212 and 214 respectively, the connecting element 162 being arcuate to conform to the cylindrical surface 130 of the grip member 128.

The lever member 148 includes a pair of collinear pivot elements 164 and 170, each pivot element having fixed ends 166 and 172, and opposite free ends 168 and 174 respectively. The fixed ends 166 and 172 extend generally perpendicularly to the second ends 154 and 160 of the side elements 150 and 156, and are connected thereto with radiused connections 216 and 218 respectively. The free ends 168 and 174 of the pivot elements 164 and 170 point inward and pivotally engage the pivot holes 136 and 142 respectively, of the grip member 128 so that the lever member 148 will be pivoted in an arcing path from a closed position shown by arrow 176, alongside the grip member 128 and substantially parallel to the longitudinal axis of the grip member 128 wherein the rotary hand tool 120, with no impediment to comfortable hand grasping and operating, will be rotated freely and quickly, to an open position shown by arrow 178, projecting outward from the grip member 128 wherein the rotary hand tool 120 will be operated with increased torque to turn a rotary fastener. In the open position 178, the rotary hand tool 120 may be operated with one hand, either right or left, or with both hands together.

A first plane containing the connecting element 162, is generally perpendicular to a second plane containing the side elements 150 and 156, and the pivot elements 164 and 170.

The invention includes a unique structure for assembling the lever member 148 onto the grip member 128, wherein the grip member 128 includes two slots 192 and 196 disposed on opposite sides of the grip member 128 and aligned generally with the longitudinal axis, the slots 192 and 196 communicating with the pivot holes 136 and 142 respectively, the slot 192 including innermost surface 194 and a pair of sidewalls 193, and the slot 196 including innermost surface 198 and a pair of sidewalls 197, the distance between the innermost surfaces 194 and 198 of the slots 192 and 196 tapering inward from adjacent the pivot holes 136 and 142 toward the second end 134 of the grip member 128. The pivot holes 136 and 142 include bottom surfaces 138 and 144 respectively, spaced apart less than the distance between the innermost surfaces 194 and 198 of the slots 192 and 196 adjacent the pivot holes 136 and 142, so that upon assembling the lever member 148 onto the grip member 128, the pivot elements 164 and 170 will engage the slots 192 and 196 at the second end 134 of the grip member 128 without bias, the sliding movement of the pivot elements along the slot taper will resiliently expand the lever member 148, the slot sidewalls 193 and 197 will guide the pivot elements 164 and 170 toward the pivot holes 136 and 142 and the pivot elements 164 and 170 will enter the pivot holes 136 and 142 respectively, enabling the lever member 148 to contract in response to the resilient bias of the lever member 148. The invention may thereby be assembled quickly and easily, with no tools, by simply snapping the parts together by hand.

The lever handle 126 has a detent including a pair of generally opposite knobs 200 and 202, being one piece with 130 of the grip member 128, each knob placed between the ridges which are adjacent one of the pivot holes. Knob 200 is placed between ridges 182 and 184, and knob 202 is placed between ridges 188 and 190. The knobs 200 and 202 project outward into the path of the lever member 148 such that the lever member 148 expands resiliently in response to passing over the knobs 200 and 202 and contracts so as to be releasably held behind the knobs 200 and 202 in the closed position 176.

Figure 2:
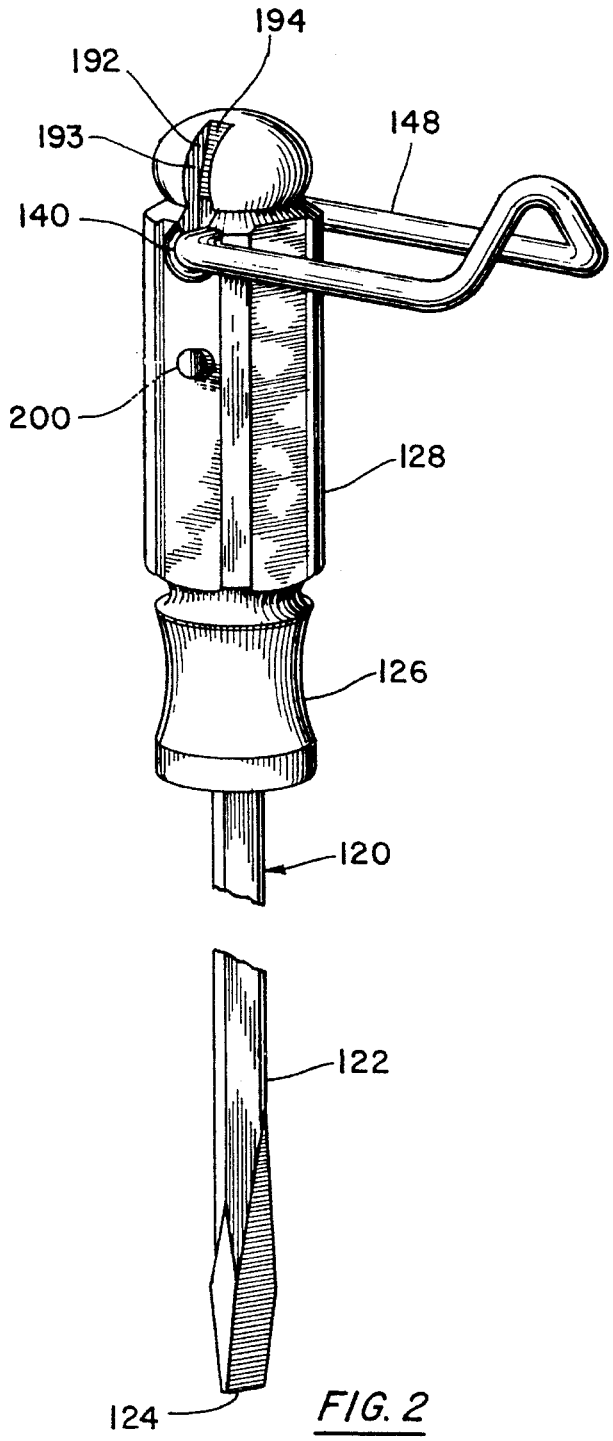
FIG. 2 is a perspective view of another rotary hand tool having a lever handle constructed in accordance with the invention.
Figure 14:
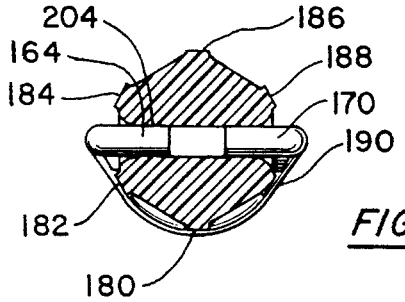
FIG. 14 is a top cross-sectional view of still another lever handle constructed in accordance with the invention, taken along line 13—13 of FIG. 10.
Figure 13:
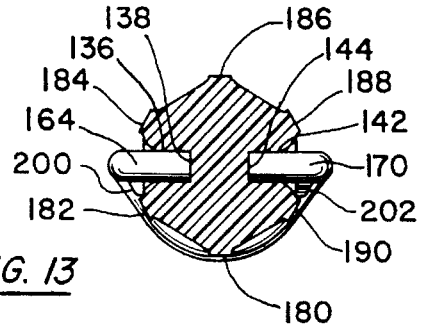
FIG. 13 is a top cross-sectional view of the lever handle of FIG. 2, taken along line 13—13 of FIG. 10.
Figure 11:
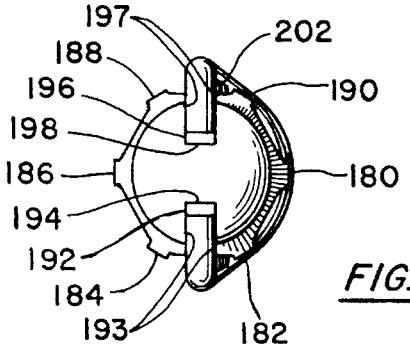
FIG. 11 is a top plan view of the lever handle of FIG. 2.
Figure 12:
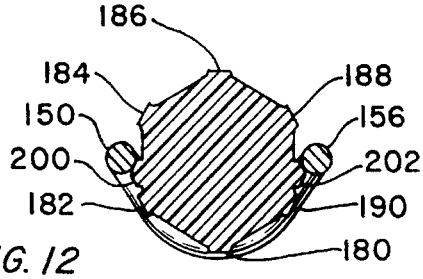
FIG. 12 is a top cross-sectional view of the lever handle of FIG. 2, taken along line 12—12 of FIG. 10.
Figure 9:
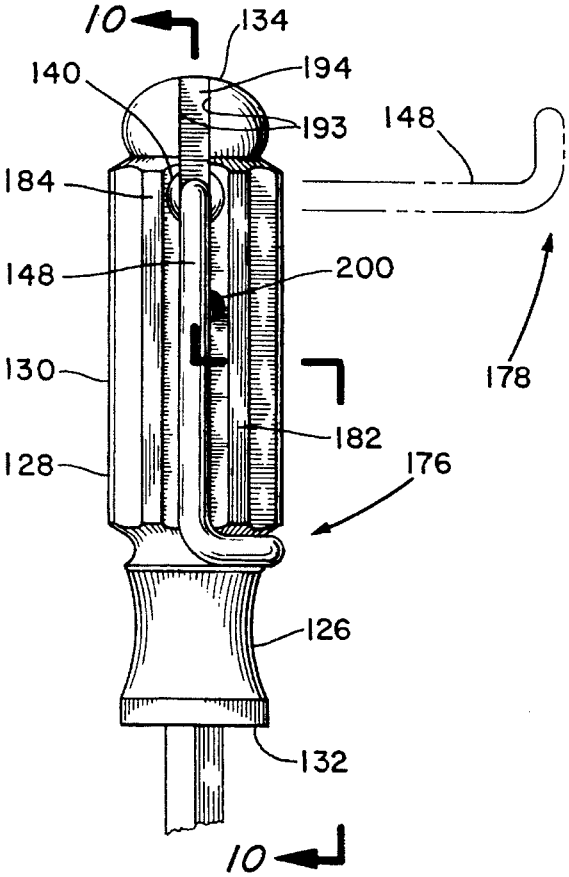
FIG. 9 is a left side view of the lever handle of FIG. 2.
Figure 10:
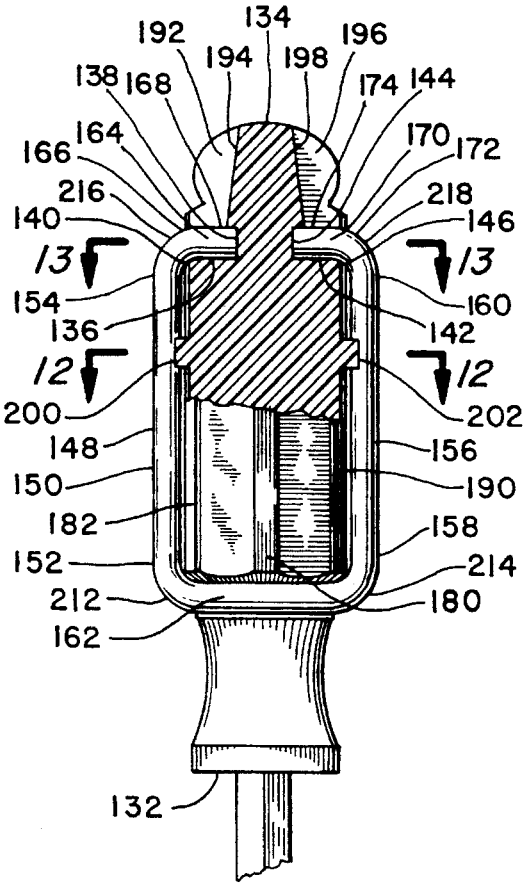
FIG. 10 is a front elevational cross-sectional view of the lever handle of FIG. 2, taken along line 10—10 of FIG. 9.

Referring now to FIG. 14, as well as to FIGS. 2,9,10,11 and 12, another lever handle constructed in accordance with the invention is shown in FIG. 14, and is similar to the invention of FIG. 2 except that the pivot holes 136 and 142 communicate with one another, forming one continuous hole 204 through the grip member 128.

It is to be understood that the above detailed description of embodiments of the invention is provided by way of example only. Various details of design and construction may be modified without departing from the true spirit and scope of the invention as set forth in the appended claims.

The embodiments of the invention in which an exclusive property or privilege is claimed are defined as follows:

1. A lever handle for a rotary hand tool having a shank with a tip configured to engage and turn a rotary fastener, the lever handle enabling operation with one hand to apply increased torque to the rotary fastener, the lever handle comprising:

(a) a grip member having a longitudinal axis, a generally cylindrical surface extending along the longitudinal axis and having a diameter suitable for hand grasping, opposite first and second ends, the shank extending collinearly from the first end, the grip member having two collinear pivot holes transverse to the axis of the grip member, the pivot holes juxtaposed with the second end of the grip member;

(b) a lever member, the lever member having a one piece structure, being generally U-shaped and resilient, and including (c) a pair of side elements, the side elements being generally parallel and including opposite first and second ends;

(d) a connecting element disposed between the first ends of the side elements and connected thereto;

(e) a pair of collinear pivot elements, each pivot element having opposite fixed and free ends, the fixed ends connected to and extending generally perpendicularly to the second ends of the side elements, the free ends pointing inward and pivotally engaging the pivot holes of the grip member, the pivot elements biased toward one another by the resilience of the U-shaped lever member to retain the pivot elements in the pivot holes, so that the lever member will be pivoted in an arcing path from a closed position alongside the grip member and substantially parallel to the longitudinal axis of the grip member wherein the rotary hand tool will be rotated freely and quickly, to an open position projecting outward from the grip member adjacent the second end of the grip member for enabling the rotary hand tool to be operated with one hand with increased torque to turn a rotary fastener; and (f) a detent disposed on the side of the grip member, the detent including a projecting portion being one piece with the grip member, the projecting portion projecting outward into the path of the lever member as the lever member is moved between the open position and the closed position, such that the side elements of the U-shaped lever member, biased through the connecting element, expand resiliently apart from one another in response to passing over the projecting portion, and contract so as to be releasably held behind the projecting portion in the closed position.

2. The lever handle of claim 1, wherein the cylindrical surface of the grip member includes a circumference and a plurality of longitudinal ridges arrayed around the circumference of the grip member.

3. The lever handle of claim 2, wherein the pivot holes communicate with one another.

4. The lever handle of claim 2, having a structure for assembling the lever member onto the grip member, wherein:

(a) the grip member includes two slots disposed on opposite sides of the grip member and aligned generally with the longitudinal axis, the slots communicating with the pivot holes, each slot including a pair of sidewalls, the slots including innermost surfaces, the distance between the innermost surfaces of the slots tapering inward from adjacent the pivot holes toward the second end of the grip member; so that upon assembling the lever member onto the grip member (b) the pivot elements will engage the slots at the second end of the grip member without bias, the sliding movement of the pivot elements along the slot taper will resiliently expand the lever member, the slot sidewalls will guide the pivot elements toward the pivot holes, and the pivot elements will enter the pivot holes, enabling the lever member to contract in response to the resilient bias of the lever member.

5. The lever handle of claim 4, wherein the grip member includes a pair of generally opposite ridges, the pivot holes are located on corresponding surfaces of the pair of opposite ridges and the lever member is pivotally attached to the grip member by entering into the pivot holes.

6. The lever handle of claim 5, wherein the detent includes a projecting portion on one of the pair of opposite ridges, the projecting portion projecting outward into the path of the lever member to resiliently expand the lever member as the lever member is moved between the open position and the closed position, a generally longitudinal groove located along the projecting portion such that the lever member contracts resiliently into the groove when the lever member is in the closed position so as to be releasably held in the closed position.

7. The lever handle of claim 4, wherein each of the pivot holes is located between adjacent ridges.

8. The lever handle of claim 7, wherein the detent includes a knob placed between the ridges which are adjacent at least one of the pivot holes, the knob projecting outward into the path of the lever member such that the lever member expands resiliently to pass over the knob and contracts so as to be releasably held behind the knob in the closed position.

9. A lever handle for a rotary hand tool having a shank with a tip configured to engage and turn a rotary fastener, the lever handle enabling operation with one hand to apply increased torque to the rotary fastener, the lever handle comprising:

(a) a grip member having a longitudinal axis, a generally cylindrical surface extending along the longitudinal axis and having a diameter suitable for hand grasping, the cylindrical surface of the grip member including a circumference and a plurality of longitudinal ridges arrayed around the circumference, the plurality of ridges including a pair of generally opposite ridges, the grip member having opposite first and second ends, the shank extending collinearly from the first end, the grip member having two collinear pivot holes generally perpendicular to the axis of the grip member, the pivot holes juxtaposed with the second end of the grip member, the pivot holes being located on corresponding surfaces of the pair of opposite ridges, the outer edges of the pivot holes being radiused;

(b) a lever member, the lever member made of round cross-section rod, having a one piece structure, being generally U-shaped and resilient, and including (c) a pair of side elements, the side elements being generally parallel and including opposite first and second ends;

(d) a connecting element disposed between the first ends of the side elements and connected thereto with radiused connections, the connecting element being arcuate to conform to the cylindrical surface of the grip member;

(e) a pair of collinear pivot elements, each pivot element having opposite fixed and free ends, the fixed ends extending generally perpendicularly to the second ends of the side elements and connected thereto with radiused connections, the free ends pointing inward and pivotally engaging the pivot holes of the grip member so that the lever member will be pivoted in an arcing path from a closed position alongside the grip member and substantially parallel to the longitudinal axis of the grip member wherein the rotary hand tool will be rotated freely and quickly, to an open position projecting outward from the grip member adjacent the second end of the grip member for enabling the rotary hand tool to be operated with one hand with increased torque to turn a rotary fastener;

(f) a first plane containing the connecting element and a second plane containing the side elements and the pivot elements, the first plane being generally perpendicular to the second plane;

(g) a structure for assembling the lever member onto the grip member, wherein the grip member includes two slots disposed on opposite sides of the grip member and aligned generally with the longitudinal axis, the slots communicating with the pivot holes, each slot including a pair of sidewalls, the slots including innermost surfaces, the distance between the innermost surfaces of the slots tapering inward from adjacent the pivot holes toward the second end of the grip member; the pivot holes including bottom surfaces spaced apart less than the distance between the innermost surfaces of the slots adjacent the pivot holes; so that upon assembling the lever member onto the grip member, the pivot elements will engage the slots at the second end of the grip member without bias, the sliding movement of the pivot elements along the slot taper will resiliently expand the lever member, the slot sidewalls will guide the pivot elements toward the pivot holes, and the pivot elements will enter the pivot holes, enabling the lever member to contract in response to the resilient bias of the lever member;

(h) a detent disposed on the side of the grip member, the detent including a projecting portion on each of the pair of opposite ridges, the projecting portion and the grip member being one piece, the projecting portions projecting outward into the path of the lever member as the lever member is moved between the open position and the closed position, such that the side elements of the U-shaped lever member, biased through the connecting element, expand resiliently apart from one another in response to passing over the projecting portion, a generally longitudinal groove located along each projecting portion such that the side elements of the lever member contract resiliently into the grooves when the lever member is in the closed position so as to be releasably held in the closed position.

10. A lever handle for a rotary hand tool having a shank with a tip configured to engage and turn a rotary fastener, the lever handle enabling operation with one hand to apply increased torque to the rotary fastener, the lever handle comprising:

(a) a grip member having a longitudinal axis, a generally cylindrical surface extending along the longitudinal axis and having a diamete suitable for hand grasping, the cylindrical surface of the grip member including a circumference and a plurality of longitudinal ridges arrayed around the circumference, the grip member having opposite first and second ends, the shank extending collinearly from the first end, the grip member having two collinear pivot holes generally perpendicular to the axis of the grip member, the pivot holes juxtaposed with the second end of the grip member, each of the pivot holes being located between adjacent ridges, the outer edges of the pivot holes being radiused;

(b) a lever member, the lever member made of round cross-section rod, having a one piece structure, being generally U-shaped and resilient, and including (c) a pair of side elements, the side elements being generally parallel and including opposite first and second ends;

(d) a connecting element disposed between the first ends of the side elements and connected thereto with radiused connections, the connecting element being arcuate to conform to the cylindrical surface of the grip member;

(e) a pair of collinear pivot elements, each pivot element having opposite fixed and free ends, the fixed ends extending generally perpendicularly to the second ends of the side elements and connected thereto with radiused connections, the free ends pointing inward and pivotally engaging the pivot holes of the grip member so that the lever member will be pivoted in an arcing path from a closed position alongside the grip member and substantially parallel to the longitudinal axis of the grip member wherein the rotary hand tool will be rotated freely and quickly, to an open position projecting outward from the grip member adjacent the second end of the grip member for enabling the rotary hand tool to be operated with one hand with increased torque to turn a rotary fastener;

(f) a first plane containing the connecting element and a second plane containing the side elements and the pivot elements, the first plane being generally perpendicular to the second plane;

(g) a structure for assembling the lever member onto the grip member, wherein the grip member includes two slots disposed on opposite sides of the grip member and aligned generally with the longitudinal axis, the slots communicating with the pivot holes, each slot including a pair or sidewalls, the slots including innermost surfaces, the distance between the innermost surfaces of the slots tapering inward from adjacent the pivot holes toward the second end of the grip member; the pivot holes including bottom surfaces spaced apart less than the distance between the innermost surfaces of the slots adjacent the pivot holes; so that upon assembling the lever member onto the grip member, the pivot elements will engage the slots at the second end of the grip member without bias, the sliding movement of the pivot elements along the slot taper will resiliently expand the lever member, the slot sidewalls will guide the pivot elements toward the pivot holes, and the pivot elements will enter the pivot holes, enabling the lever member to contract in response to the resilient bias of the lever member;

(h) a detent disposed on the side of the grip member, the detent including a pair of generally opposite knobs, the knobs and the grip member being one piece, each knob placed between the ridges which are adjacent one of the pivot holes, the knobs projecting outward into the path of the lever member as the lever member is moved between the open and the closed position, such that the side elements of the U-shaped lever member, biased through the connecting element, expand resiliently apart from one another in response to passing over the hobs and contract so as to be releasably held behind the knobs in the closed position.

* * * * *